US010262766B2

(12) United States Patent
Uhland et al.

(10) Patent No.: US 10,262,766 B2
(45) Date of Patent: Apr. 16, 2019

(54) PROCESS OF GENERATING GERMANIUM

(71) Applicant: Mallinckrodt Nuclear Medicine LLC, St. Louis, MO (US)

(72) Inventors: William C. Uhland, St. Charles, MO (US); David Wayne Pipes, Wildwood, MO (US); Melissa Dianne Perrigo, Herculaneum, MO (US)

(73) Assignee: MALLINCKRODT NUCLEAR MEDICINE LLC, Hazelwood, MO (US)

( * ) Notice: Subject to any disclaimer, the term of this patent is extended or adjusted under 35 U.S.C. 154(b) by 1126 days.

(21) Appl. No.: 14/316,271

(22) Filed: Jun. 26, 2014

(65) Prior Publication Data

US 2015/0003576 A1 Jan. 1, 2015

Related U.S. Application Data

(60) Provisional application No. 61/840,103, filed on Jun. 27, 2013.

(51) Int. Cl.

| | |
|---|---|
| ***G21G 1/00*** | (2006.01) |
| ***G21G 1/10*** | (2006.01) |
| ***H05H 6/00*** | (2006.01) |

(52) U.S. Cl.

CPC ..... *G21G 1/001* (2013.01); *G21G 1/10* (2013.01); *H05H 6/00* (2013.01); *G21G 2001/0094* (2013.01)

(58) Field of Classification Search

CPC ..... G21G 1/00; G21G 1/10; G21G 2001/0094
See application file for complete search history.

(56) References Cited

U.S. PATENT DOCUMENTS

| | | | | |
|---|---|---|---|---|
| 2,887,373 | A * | 5/1959 | Winkler | C23G 1/02 134/3 |
| 8,170,172 | B2 | 5/2012 | Uhland | |
| 2007/0207075 | A1 | 9/2007 | Fassbender | |

FOREIGN PATENT DOCUMENTS

| | | | |
|---|---|---|---|
| CN | 102382994 | A | 3/2012 |

OTHER PUBLICATIONS

English translation of First Office Action for related CN Patent Application No. 20140034060.3 dated Dec. 2, 2016, 6 pages.

Aardaneh et al. "Ga2O for target, solvent extraction for radiochemical separation and SnO2 for the preparation of Ge68/Ga68 generator," Journal of Radioanalytical and Nuclear Chemistry, 2006.

Shealy, Norman C. et al., Gallium-68 as a Scanning Agent for Intracranial Lesions, The Journal of Nuclear Medicine, Jan. 1, 1964, pp. 161-162, vol. 5, Reston, Virginia.

Bokhari, Tanveer Hussain et al., Concentration of <68>Ga via solvent extraction, Applied Radiation and Isotopes, 2009, pp. 100-102, vol. 67, No. 1, Elsevier, Oxford, Great Britain.

International Search Report and Written Opinion of the International Searching Authority regarding PCT/US2014/044397 dated Sep. 26, 2014; 12 pgs.

(Continued)

*Primary Examiner* — Jack W Keith
*Assistant Examiner* — Lily C Garner

(57) ABSTRACT

The present disclosure generally relates to a new process for generating germanium-68 from an irradiated target body. The process includes irradiation of the target body followed by various extraction techniques to generate the germanium-68.

12 Claims, 3 Drawing Sheets

(56) References Cited

OTHER PUBLICATIONS

EPO communication dated Feb. 17, 2017 from related EP Application No. 14742078, 6 pages.
Rule 114(2) EPC communication dated Dec. 12, 2016 from related EP Application No. 14742078, 3 pages.
Stevenson, NR et al., "A New Production Method for Germanium-68," in Synthesis and applications of isotopes and isotopically labelled compounds; Strasbourg (France); 1994, 5 pages.
Loc'h C, et al., "A New Preparation of Germanium 68," The International Journal of Applied Radiation and Isotopes, 1982, vol. 33, No. 4, pp. 267-270.
Razbash AA, et al., "Production of Germanium-68 in Russia" Abstract from the Sixth Workshop on Target and Target Chemistry, Vancouver B.C., CA, Aug. 17-19, 1995, 3 pages.
Office Action dated Mar. 16, 2018 from related AU Application No. 2014302276, 3 pages.
Office Action dated Sep. 29, 2017 from related CN Application No. 201480034060.3, 6 pages.
Office Action dated Oct. 17, 2017 from related CN Application No. 201480034060.3, 6 pages.
Office Action dated Nov. 30, 2017 from related AU Application No. 2014302276, 4 pages.
Office Action dated Dec. 19, 2017 from related JP Application No. 2016-524207, 12 pages.
Phillips, D., "Radioisotope Production at Los Alamos National Laboratory," 2002, 43 pages.
"Production of Long Lived Parent Radionuclides for Generators: 68Ge, 82Sr, 90Sr and 188W," International Atomic Energy Agency, 2010, 128 pages.

* cited by examiner

PROCESS OF GENERATING GERMANIUM

CROSS-REFERENCE TO RELATED APPLICATION

This application claims priority from U.S. Provisional Patent Application Ser. No. 61/840,103, filed Jun. 27, 2013, the entire content of which is herein incorporated by reference.

FIELD

The present disclosure generally relates to a new process for generating germanium-68 from an irradiated target body. The process includes irradiation of the target body followed by various extraction techniques to generate the germanium-68.

BACKGROUND

Positron emission tomography (PET) is an in vivo imaging method that uses positron emitting radiotracers to track the biochemical, molecular, and/or pathophysiological processes in humans and animals. In PET systems, positron-emitting isotopes serve as beacons for identifying the exact location of diseases and pathological processes under study without surgical exploration of the human body. With these non-invasive imaging methods, the diagnosis of diseases may be more comfortable for patients, as opposed to the more traditional and invasive approaches, such as exploratory surgeries.

One such exemplary radiopharmaceutical agent group includes gallium-68 (Ga-68), which may be obtained from the radioisotope germanium-68 (Ge-68). Ge-68 has a half-life of about 271 days, decays by electron capture to Ga-68, and lacks any significant photon emissions. Ga-68 decays by positron emission. These properties make Ge-68 an ideal radioisotope for calibration and transmission sources. Thus, the availability of the long-lived parent, Ge-68, is of significant interest because of its generation of the shorter-lived gallium radioisotope.

There continues to be a need for an improved process to produce Ge-68 used to obtain Ga-68 for PET imaging methods. The present disclosure is directed to an improved process for generating Ge-68 from an irradiated target body.

SUMMARY

Briefly, therefore, the present disclosure is directed to a process for generating a radioisotope. The process comprises: bombarding a target body including a starting material, wherein the bombardment of the starting material produces a radioisotope within the target body; allowing the bombarded target body to decay; stripping the bombarded target body with an acidic mixture to create a stripped solution; extracting the radioisotope from the stripped solution using a non-polar solvent to remove the acidic mixture and create a non-polar solvent fraction including the radioisotope; washing the non-polar solvent fraction including the radioisotope; and, extracting the radioisotope from the non-polar solvent fraction using water.

The present disclosure is further directed to a method of using a target body to produce germanium-68. The method comprises: bombarding a target body including a gallium-nickel alloy, wherein the bombardment of the gallium-nickel alloy produces a germanium radioisotope within the target body; allowing the bombarded target body to decay; stripping the bombarded target body with an acidic mixture to create a stripped solution; extracting the germanium radioisotope from the stripped solution using a non-polar solvent to remove the acidic mixture and create a non-polar solvent fraction including the germanium radioisotope; washing the non-polar solvent fraction including the germanium radioisotope; extracting the germanium radioisotope from the non-polar solvent fraction using water.

The present disclosure is further directed to a target body for use in the production of germanium-68. The target body comprises: a base layer including a thermally conductive material and a coolant path; and a starting material disposed on the base layer, the starting material including a gallium-nickel alloy that is capable of forming germanium-68 after being irradiated.

Various refinements exist of the features noted above in relation to the various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of the present disclosure without limitation to the claimed subject matter.

BRIEF DESCRIPTION OF THE FIGURES

Various features, aspects, and advantages of the present disclosure will become better understood when the following detailed description is read with reference to the accompanying figures in which like characters represent like parts throughout the figures, wherein.

DETAILED DESCRIPTION

The present disclosure is directed to a process for generating a radioisotope. In particular, the present disclosure is directed to a process for generating Ge-68 from a radioisotope starting material. The present disclosure is also directed to a target body for use in the production of the Ge-68, as well as a method of using a target body to produce the Ge-68.

The process generally comprises: bombarding a target body including a starting material, wherein the bombardment of the starting material produces a radioisotope within the target body; allowing the bombarded target body to decay; stripping the bombarded target body with an acidic mixture to create a stripped solution; extracting the radioisotope from the stripped solution using a non-polar solvent to remove the acidic mixture and create a non-polar solvent fraction including the radioisotope; washing the non-polar solvent fraction including the radioisotope; and, extracting the radioisotope from the non-polar solvent fraction using water.

The process is an improved process in that it repeatedly produces a high purity radioisotope (e.g., germanium-68) and is also easy to perform in a hot-cell. Additionally, the improved process decreases the formation of volatile germanium compounds and prevents the loss of these species if they are formed. That is, the improved process reduces the formation of volatile germanium compounds, but, if any are formed, they are retained and trapped. Furthermore, the improved process contains less HCl in the final solution.

A. Target Body

Figure 3:
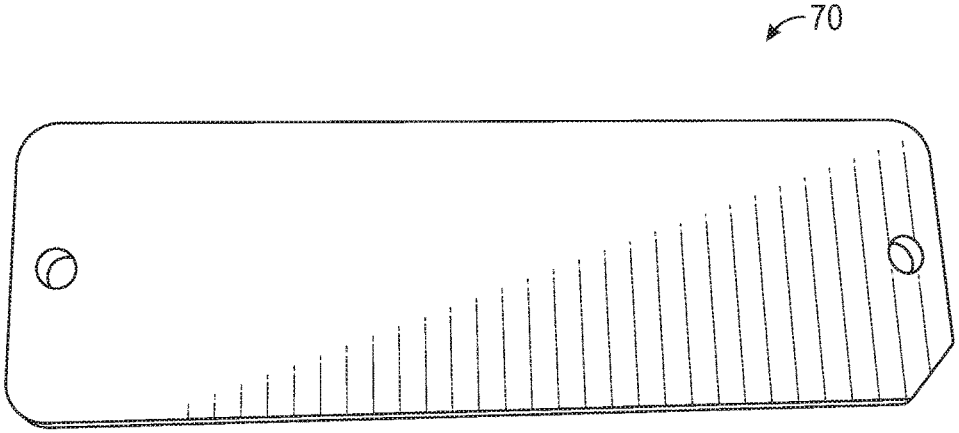
FIG. 3 is an embodiment of the face of a target body in accordance with the present disclosure.
Figure 4:
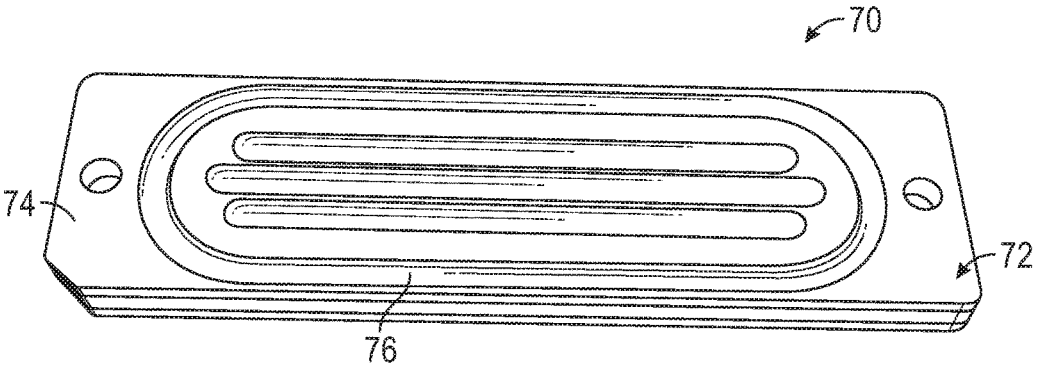
FIG. 4 is an embodiment of the back of a target body in accordance with the present disclosure.

In an embodiment of the present disclosure, a target body is shown in FIGS. 3 and 4 and generally referenced 70. The target body 70 is used for the production of the radioisotope, such as Ge-68. The target body 70 is used during the bombardment process to produce the radioisotope from a starting material. In some embodiments of the present disclosure, only one target body 70 is used in the bombardment process. In other embodiments, two (dual) target bodies are used in the bombardment process, though more than two is contemplated. When dual target bodies are used in the bombardment process, a greater amount of the target radioisotope, such as Ge-68, may be recovered at the end of the process. When dual target bodies are used, each target body 70 may include the same or different amounts of the radioisotope starting material as disclosed elsewhere in this disclosure. Similarly, the construction of the dual target bodies may be such that the target bodies have identical structures and components, for example.

In some embodiments, the target body 70 comprises a base layer 72. The base layer 72 may include a thermally conductive material 74 and a coolant path 76. The target body 70 may have multiple layers, at least one of which is adapted for producing a radioisotope when that layer is irradiated with energetic charged particles. In some embodiments, the target body 70 includes a base layer 72 that includes an enriched radioisotope starting material, which may produce a radioisotope when bombarded or irradiated with the energetic charged particles. In turn, the radioisotope may be used alone or in combination with other substances (e.g., tagging agents) as a radiopharmaceutical for medical diagnostic or therapeutic purposes.

The base layer 72 may include a radioisotope starting material disposed on the base layer 72. In some embodiments of the present disclosure, the target body 70 includes from about 1.0 grams to about 2.0 grams of the radioisotope starting material. In other embodiments, the target body 70 includes about 1.2 grams of the radioisotope starting material. As an example, the starting material may be provided in powder form and thereafter pressed into the target body 70.

In some embodiments of the present disclosure, the starting material includes an alloy comprising gallium. The alloy may include from about 10% to about 80%, in one embodiment from about 60% to about 75% gallium, by weight of the alloy. The alloy may also include a metal selected from the group consisting of nickel, indium, tin, iron, ruthenium, osmium, chromium, rhenium, molybdenum, tungsten, manganese, cobalt, rhodium and combinations thereof. The metal may be present in the alloy in an amount of from about 20% to about 90%, in one embodiment from about 25% to about 40%, by weight of the alloy.

In some embodiments of the present disclosure, the alloy includes gallium and nickel. In these embodiments, the gallium-nickel alloy includes from about 60% to about 75% gallium and from about 25% to about 40% nickel, by weight of the alloy. In one embodiment, the gallium-nickel alloy includes about 60% gallium and about 40% nickel, by weight of the alloy. In another embodiment, the gallium-nickel alloy includes about 61% gallium and about 39% nickel, by weight of the alloy.

The base layer 72 of the target body 70 may include a metal, such as copper, aluminum, nickel and/or other conductive material(s). For example, the base layer 72 may be molded out of aluminum and then coated with copper. Being conductive, the base layer 72 of the target body 70 may be adapted to transfer heat efficiently away from the target body 70 as temperature increases while the target body 70 is irradiated. Further, in some embodiments, a coolant path/channel 76 may be formed as part of a channel or groove lengthwise along the target body 70. The coolant channel 76 facilitates fluid flow along the target body 70 so that heat may be removed from the target body 70 while the target body 70 is irradiated with charged particles.

During bombardment of the target body 70, nuclear interactions between the colliding charged particles and atomic nuclei of materials of the target body 70 may transform a portion of those nuclei into radioisotopes. For example, after bombardment, the base layer 72 may include germanium radioisotopes, such as Ge-68, Ge-69, and Ge-71. The base layer 72 may also include other radioisotopes after bombardment, such as Cu-62, Cu-64, Cu-61,Cu-60, Zn-62 and Zn-63.

B. Bombardment

In accordance with the present disclosure, the target body 70 including the starting material is irradiated via bombardment. The bombardment of the starting material can produce a radioisotope within the target body 70. In one embodiment of the present disclosure, a gallium-nickel alloy is the starting material and after bombardment germanium radioisotopes are produced. In another embodiment of the present disclosure, the gallium-nickel alloy is bombarded to produce the Ge-68 radioisotope.

One exemplary method of irradiation is by proton bombardment. In some embodiments of the present disclosure, the target body 70 is bombarded by a particle accelerator. For example, the proton bombardment can be accomplished by inserting the target body 70 into a linear accelerator beam at a suitable location whereby the target is bombarded at an integrated beam intensity. In some embodiments of the present disclosure, the target body 70 is bombarded with a beam current of from about 170 micro-Amperes to about 300 micro-Amperes, in one embodiment from about 175 micro-Amperes to about 185 micro-Amperes, and in another embodiment at least about 180 micro-Amperes. In other embodiments, the target body 70 is bombarded with a beam current of at least about 300 micro-Amperes. In some embodiments, the target body 70 is bombarded at a beam energy of from about 25.0 MeV to about 35.0 MeV, in one embodiment from about 28.0 MeV to about 30.0 MeV, and in one embodiment from about 29.0 MeV to about 29.5 MeV.

Figure 1:
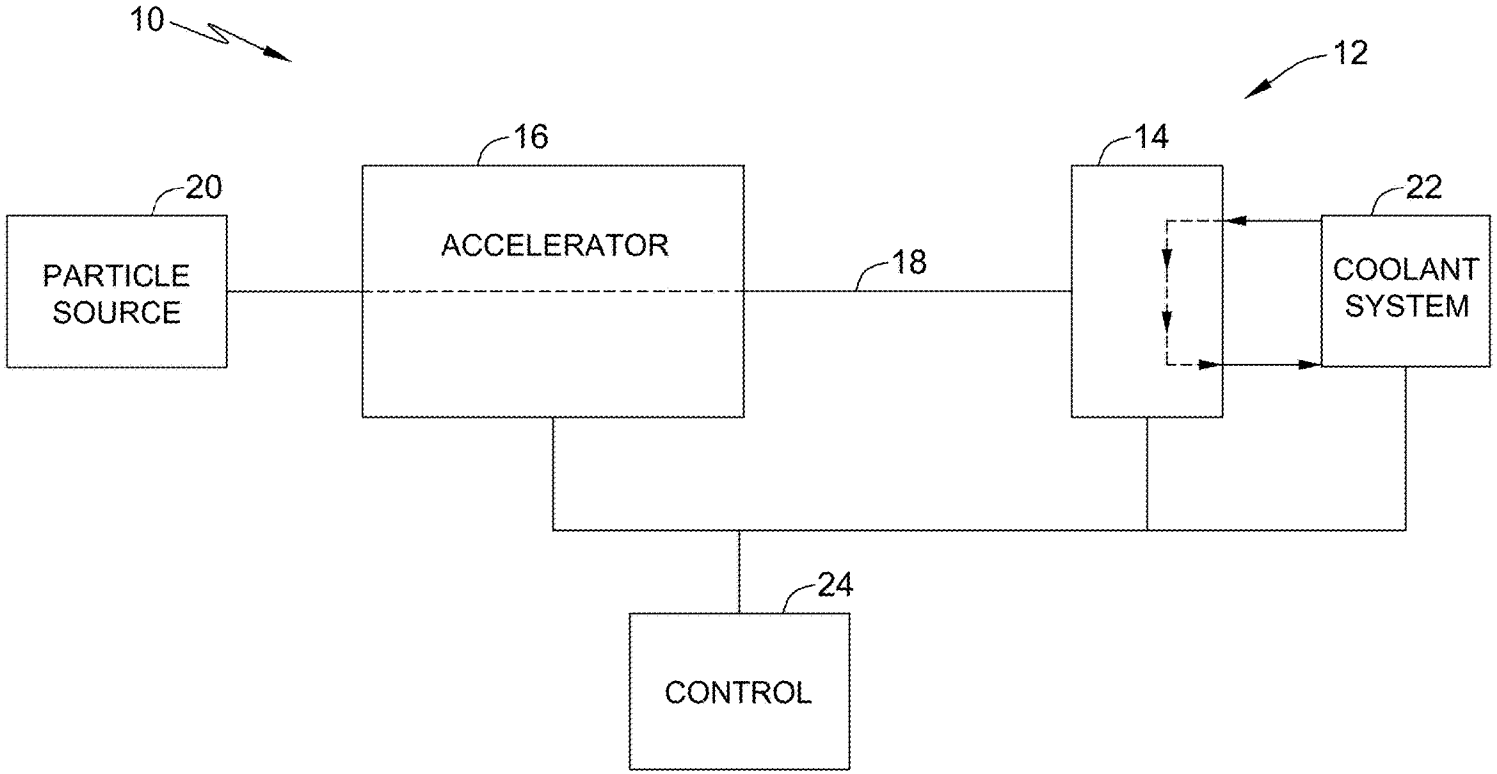
FIG. 1 is a block diagram of a particle accelerating system of one embodiment.

Turning now to FIG. 1, a block diagram of an exemplary particle accelerating system 10 is disclosed. The system 10 includes an exemplary target body 12 having multiple layers, at least one of which is adapted for producing a radioisotope when that layer is irradiated with energetic charged particles. The target body 12 may include a base layer 14, including an enriched radioisotope starting material, which may produce a radioisotope when bombarded or irradiated with the energetic charged particles. In turn, the radioisotope may be used alone or in combination with other substances (e.g., tagging agents) as a radiopharmaceutical for medical diagnostic or therapeutic purposes. The base layer 14 may include a radioisotope starting material, such as a gallium-nickel alloy.

The base layer 14 of the target body 12 may include a metal, such as copper, aluminum, nickel and/or other conductive material(s). Being conductive, the base layer 14 of the target body 12 may be adapted to transfer heat efficiently away from the target body 12 as temperature increases while the target body 12 is irradiated.

The particle accelerating system 10 includes a particle accelerator 16 configured to accelerate charged particles, as shown by line 18. The charged particles 18 accelerate to attain enough energy to produce radioisotope material once the particles 18 collide with the target body 12. Thus, the base layer 14 may include a mixture of radioisotope and radioisotope starting material. Production of the radioisotope is facilitated through a nuclear reaction occurring once the accelerated particles 18 interact with the starting material of the base layer 14. For example, when producing radioisotope Ge-68, a gallium-nickel alloy may be irradiated with protons 18 accelerated via the accelerator 16. The protons 18 may originate from a particle source 20 that injects the charged particles 18 into the accelerator 16 so that the particles 18 may be accelerated towards the target body 12.

As the accelerated charged particles 18 collide with the target body 12, a substantial amount of the particles' kinetic energy may be absorbed by the target body 12. Absorption of the energy imparted by the accelerated particles 18 may cause the target body 12 to heat up. To mitigate overheating of the target body 12, the target body 12 may be coupled to a coolant system 22 disposed adjacent to the target body 12. The coolant system 22 may include fluid connectors that are fluidly coupled to the target body 12 so that fluid, such as water, may circulate along or through the target body 12, thereby removing heat absorbed by the target body 12 during irradiation of the same. In the illustrated embodiment, the coolant system 22 is shown as being separate from the target body 12 and disposed behind the target body 12. In other embodiments, the cooling system 22 may be part of the target body 12, or it may be disposed remote from the target body 12.

The particle accelerating system 10 includes a control system 24 coupled to the particle accelerator 16, the target body 12, and/or the coolant system 22. The control system 24 may be configured to, for example, control parameters, such as accelerating energy of the particles 18, current magnitudes of the accelerated charged particles 18, and other operational parameters relating to the operation and functionality of the accelerator 16. The control system 24 may be coupled to the target body 12 to monitor, for example, the temperature of the target body 12. The control system 24 may be coupled to the coolant system 22 to control temperature of the coolant and/or monitor and/or control flow rate.

Figure 2:
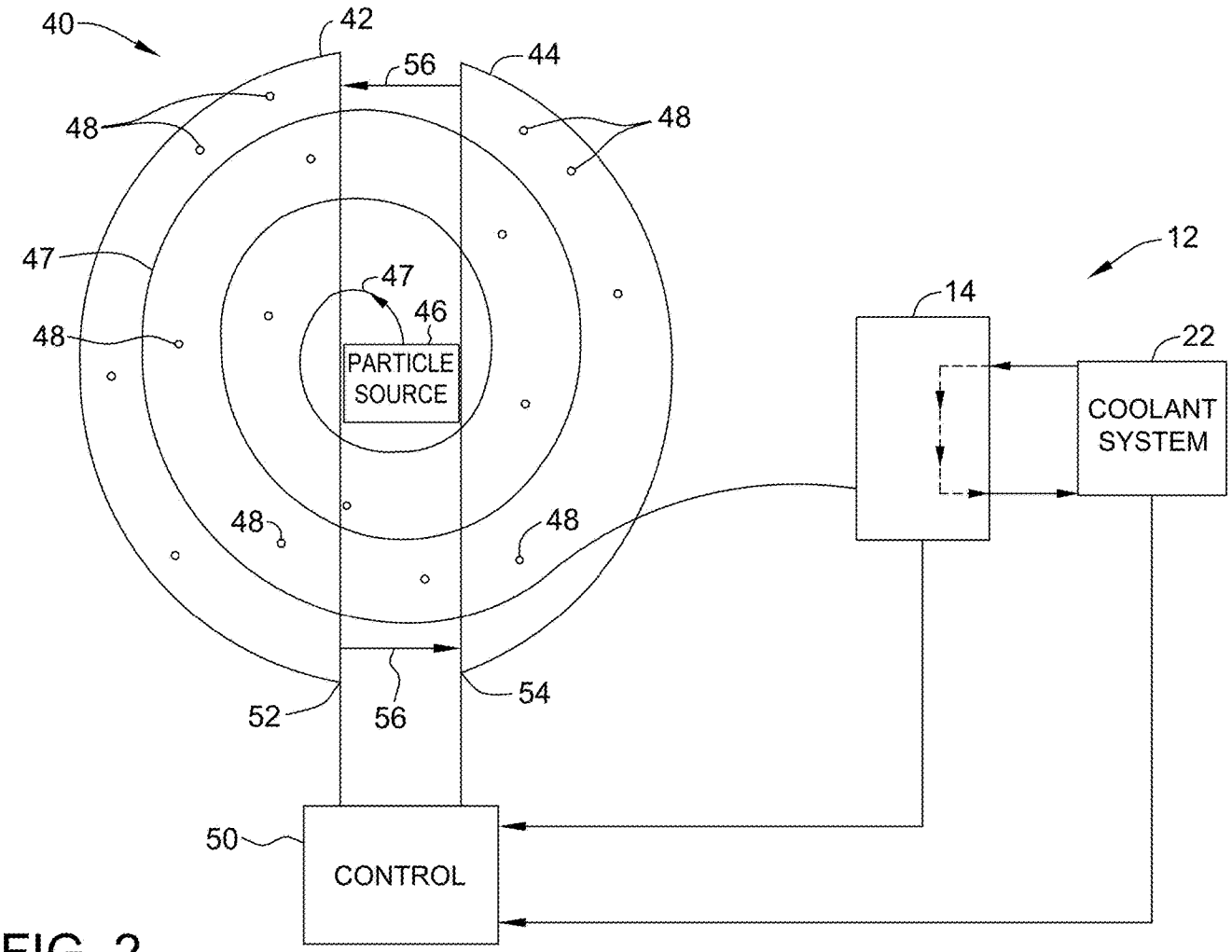
FIG. 2 is a schematic of a cyclotron of one embodiment.

In some embodiments of the present disclosure, the particle accelerator includes a cyclotron. A cyclotron can accelerate charged particles to high speeds and cause the charged particles to collide with a target to produce a nuclear reaction and subsequently create a radioisotope. Referring now to FIG. 2, an exemplary particle accelerator 40 is illustrated for use with the target body 12. The particle accelerator 40 may include a cyclotron used for accelerating charged particles, such as protons. The cyclotron 40 may employ a stationery magnetic field and an alternating electric field for accelerating charged particles. The cyclotron 40 may include two electromagnets 42, 44 separated by a certain distance. Disposed between the electromagnets 42, 44 is a particle source 46. In some embodiments, the electromagnets 42, 44 may be pie-shaped or wedge-shaped. The particle source 46 emits charged particles 47 such that the particles' 47 trajectories begin at a central region disposed between the electromagnets 42, 44. A magnetic field 48 of constant direction and magnitude is generated throughout the electromagnets 42, 44 such that the magnetic field 48 may point inward or outward perpendicular to the plane of the electromagnets 42, 44. Dots 48 depicted throughout the electromagnets 42, 44 represent the magnetic field pointing inwardly or outwardly from the plane of electromagnets 42, 44. In other words, the surfaces of the electromagnets 42, 44 are disposed perpendicular to the direction of the magnetic field.

Each of the electromagnets 42, 44 may be connected to a control 50 via connection points 52, 54, respectively. The control 50 may regulate an alternating voltage supply, for example contained within the control 50. The alternating voltage supply may be configured to create an alternating electric field in the region between the electromagnets 42, 44, as denoted by arrows 56. Accordingly, the frequency of the voltage signal provided by the voltage supply creates an oscillating electric field between the electromagnets 42, 44. As the charged particles 47 are emitted from the particle source 46, the particles 47 may become influenced by the electric field 56, forcing the particle 57 to move in a particular direction, i.e., in a direction along or against the electric field, depending on whether the charge is positive or negative. As the charged particles 47 move about the electromagnets 42, 44, the particles 47 may no longer be under the influence of the electric field. However, the particles 47 become may become influenced by the magnetic field pointing in a direction perpendicular to their velocity. At this point, the moving particles 47 may experience a Lorentz force causing the particles 47 to undergo uniform circular motion, as noted by the circular paths 47 of FIG. 2. Accordingly, every time the charged particles 47 pass the region between the electromagnets 42, 44, the particles 47 experience an electric force caused by the alternating electric field, which increases the energy of the particles 47. In this manner, repeated reversal of the electric field between the electromagnets 42, 44 in the region between the electromagnets 42, 44 during the brief period the particles 47 traverse therethrough causes the particles 47 to spiral outward towards the edges of the electromagnets 42, 44.

Eventually, the particles 47 may impact a foil (not pictured) at a certain radius, which re-directs them tangentially into the target body 12. Energy gained while the particles 47 accelerate may be deposited into the target body 12 when the particles 47 collide with the target body 12. Consequently, this may initiate nuclear reactions within the target body 12, producing radioisotopes within the layer(s) of the target body 12. The control 50 may be adapted to control the magnitude of the magnetic field 48 and the magnitude of the electric field 56, thereby controlling the velocity and, hence, the energy of the charged particles as they collide with the target body 12. The control 50 may also be coupled to the target 12 and/or the coolant system 22 to control parameters of the target 12 and/or the coolant system 22 as described above with respect to FIG. 1.

In some embodiments of the present disclosure, the target body is bombarded for about 1 day, for about 3 days, for about 5 days, for about 7 days, for about 10 days, or for about 14 days. In one particular embodiment of the present disclosure, the target body is bombarded for about 4.4 days. The length of the bombardment can affect the radioisotope produced. In particular, prolonged bombardment of the target body will produce more of the targeted radioisotope. As used herein throughout this present disclosure, "prolonged" bombardment refers to bombardment that occurs for at least five days.

C. Decay Period

After the irradiation and bombardment of the target body, the target body is generally allowed to sit for a period of time whereby unwanted short-lived isotopes will decay. In some embodiments, the target body may be processed without any wait. When the target body is processed without any wait, however, there may be some purity issues that arise from lack of adequate time to allow the target body to decay. In some embodiments, the bombarded target body is allowed to decay for about 6 days. In other embodiments, the bombarded target body is allowed to decay for about 7 days. In some embodiments, the bombarded target body is allowed to decay for about 14 days. In other embodiments, the bombarded target body is allowed to decay for at least 14 days. During this decay time, short-lived materials such as, for example, Ge-69, Ge-71, Cu-62, Cu-64, Cu-61, Cu-60, Zn-62 and Zn-63 are allowed to decay away.

D. Stripping with Acidic Mixture

After the target body or bodies including the radioisotope are allowed to decay, the body or bodies are stripped with an acidic mixture. In some embodiments, the acidic mixture may include hydrochloric acid (HCl) and nitric acid ($HNO_3$). When the target body is stripped with this acidic mixture, the radioisotope starting material dissolves and a stripped solution is formed that includes HCl, $HNO_3$ and the radioisotope. In some instances, water may also be present in the stripped solution. Stripping of the target body will also remove any copper from the target body. In some embodiments of the present disclosure, the acidic mixture that is used to strip the bombarded target body includes from about 3 M to about 6 M HCL and from about 6 M to about 15 M $HNO_3$, in some embodiments 4.5 M HCl and 10 M $HNO_3$.

In other embodiments of the present disclosure, the acidic mixture used to strip the target body may include copper (II) nitrate trihydrate ($Cu(NO_3)_2.3H_2O$) and nitric acid ($HNO_3$). When this mixture is used, and, for example, a gallium-nickel alloy target body is used, a two-fold reaction can occur. First, the copper ions in the solution can electrochemically displace any gallium, nickel and germanium starting material as shown in Reactions 1, 2 and 3:

Reaction 1—Single Displacement of Gallium with Copper $$3Cu^{++}+2Ga^{0}\rightarrow 3Cu^{0}+2Ga^{+++}$$

Reaction 2—Single Displacement of Nickel with Copper $$Cu^{++}+Ni^{0}\rightarrow Cu^{0}+Ni^{++}$$

Reaction 3—Single Displacement of Germanium with Copper $$2Cu^{++}+Ge^{0}\rightarrow 2Cu^{0}+Ge^{++++}.$$

After this displacement, the second reaction occurs, which involves the dissolution of the metallic copper formed in the nitric acid (as shown in Reaction 4), which in turn replenishes the copper (II) nitrate in the solution.

Reaction 4—Dissolution of Copper in Nitric Acid $$3Cu^{0}+8HNO_3\rightarrow 3Cu(NO_3)_2+2NO\uparrow+4H_2O.$$

The amount of acidic mixture that can be used for the stripping procedure can range from about 20 ml to about 100 ml, in one embodiment from about 60 ml to about 100 ml, in one embodiment from about 20 ml to about 40 ml. In one embodiment, the amount of acidic mixture used to strip the target body is about 30 ml. In some embodiments of the present disclosure, 3 rinses of about 10 ml each are used to strip the target body.

A charcoal vent may also be used during the stripping process. The charcoal vent includes a canister of activated charcoal that is attached to a vent hole in the top of a stripping cell used during the stripping process. The vent hole is the lone exit in from the stripping cell for any gases that may be generated during the stripping of the target body. Such gases that may be generated must pass through the vent hole and are thus captured by the activated charcoal. In some instances, this includes the capture of germanium tetrachloride.

If dual target bodies are bombarded and are being processed, then the stripped solutions are combined at the end of the stripping process prior to the subsequent extraction step. That is, each target body is stripped separately by the process disclosed above and then the two stripped solutions are combined into one for the non-polar solvent extraction step.

E. Extraction Using a Non-Polar Solvent

After the bombarded target body including the radioisotope is stripped by the acidic mixture and forms a stripped solution, a non-polar solvent is used to extract the radioisotope from the stripped solution. This step transfers a desired radioisotope from the acidic mixture into a non-polar solvent fraction including the desired radioisotope. Any non-polar solvent that is suitable in the industry may be used in the present disclosure, so long as the non-polar solvent used is within the scope of the present disclosure. Suitable non-polar solvents that may be used include heptane, hexane, cyclohexane, pentane and carbon tetrachloride. In one embodiment of the present disclosure, heptane is used as the non-polar solvent for extraction.

In some embodiments, the initial amount of non-polar solvent to be used in the extraction process is from about 100 ml to about 140 ml, in one embodiment about 120 ml. In some embodiments, prior to the stripped solution being combined with the non-polar solvent, the non-polar solvent is pre-equilibrated. The non-polar solvent may be pre-equilibrated with 10 M HCl. In particular embodiments, from about 80 ml to about 120 ml, in one embodiment about 100 ml of 10 M HCl is used to pre-equilibrate the non-polar solvent.

Once the non-polar solvent has been pre-equilibrated with the HCl, the non-polar solvent may be added to a first separator funnel ("first funnel"). Prior to the addition of the pre-equilibrated non-polar solvent to the first funnel, the first funnel may be chilled to a temperature of about 1020 C or less. After the pre-equilibrated non-polar solvent is added to the chilled first funnel, but before the stripped solution is added, an amount of concentrated 12 M HCl is added to the first funnel so that when the stripped solution is added to the first funnel, the HCl concentration will be 10 M. For example, if the strip solution contains 4.5 M HCl prior to being added to the first funnel, then the volume of the concentrated HCl to add would be 2.75 times the volume of the stripped solution. Thus, for example, if the stripped solution were 30 ml, then 82.5 ml of concentrated HCl would be added (2.75×30) to the first funnel prior to the addition of the stripped solution.

At this point, after the first separator funnel has been chilled, the pre-equilibrated non-polar solvent has been added and the requisite amount of concentrated HCl has been added, the stripped solution is then added to the first funnel. Then, the stripped solution and the non-polar solvent are mixed in the first separator funnel. The stripped solution and the non-polar solvent can be mixed from about 3 minutes to about 7 minutes, in one embodiment for about 5 minutes.

After the mixing, the stripped solution and the non-polar solvent are allowed to separate. When the separation occurs, a first acid layer and a first non-polar solvent layer are formed. The first non-polar solvent layer includes at least some of the radioisotope. In some embodiments, the first non-polar solvent layer includes about 80% of the radioisotope in the layer after the first extraction. In some embodiments, the separation takes from about 2 minutes to about 5 minutes. Once the separation occurs, the first acid layer is drained out of the first funnel into a first beaker. In some embodiments, the first beaker contains from about 3 ml to about 7 ml, in one embodiment about 5 ml of pre-equilibrated non-polar solvent. The non-polar solvent may be pre-equilibrated with 10 M HCl. In particular embodiments, from about 80 ml to about 120 ml, in one embodiment about 100 ml of 10 M HCl is used to pre-equilibrate the non-polar solvent. When the first acid layer is added to the first beaker and the first beaker contains the pre-equilibrated non-polar solvent in it, the non-polar solvent—if less dense than the acid—may float to the top of the beaker and form a cap, which will capture any germanium tetrachloride that may volatilize from the solution. In some embodiments, the non-polar solvent is denser than the acid and will migrate to the bottom of the acid.

After the first acid layer has been removed from the first funnel, then the remaining first non-polar solvent layer is drained into a second beaker and is covered. Then, the first acid layer which is in the first beaker is added back to the first funnel. When the first acid layer is placed back in the first funnel, pre-equilibrated non-polar solvent is added into the first separator funnel. In some embodiments, from about 10 ml to about 30 ml, in one embodiment about 20 ml of pre-equilibrated non-polar solvent is added into the first funnel with the first acid layer. Then, the first acid layer and the non-polar solvent are mixed (e.g., from about 3 minutes to about 7 minutes of mixing) and allowed to separate (e.g., from about 2 minutes to about 5 minutes) after mixing into the first acid layer and second non-polar solvent layer including the radioisotope.

After separation occurs between the first acid layer and the second non-polar solvent layer including the radioisotope, the first acid layer is drained into a third beaker. In some embodiments, the third beaker contains from about 3 ml to about 7 ml, in one embodiment about 5 ml of pre-equilibrated non-polar solvent. When the first acid layer is added to the third beaker and the third beaker contains the pre-equilibrated non-polar solvent in it, the non-polar solvent will float to the top of the beaker and form a cap, which will capture any germanium tetrachloride that may volatilize from the solution.

After the first acid layer has been removed from the first funnel, then the remaining second non-polar solvent layer is drained into the second beaker, which contains the previously drained first non-polar solvent layer, and is covered. Then, the first acid layer which is in the third beaker is added back to the first funnel. When the first acid layer is placed back in the first funnel, pre-equilibrated non-polar solvent is added into the first separator funnel. In some embodiments, from about 10 ml to about 30 ml, in one embodiment about 20 ml of pre-equilibrated non-polar solvent is added into the first funnel with the first acid layer. Then, the first acid layer and the non-polar solvent are mixed (e.g., from about 3 minutes to about 7 minutes of mixing) and allowed to separate (e.g., from about 2 minutes to about 5 minutes) after mixing into the first acid layer and a third non-polar solvent layer including the radioisotope.

After separation occurs between the first acid layer and the third non-polar solvent layer including the radioisotope, the first acid layer is drained into a fourth beaker. This time, however, the fourth beaker contains no pre-equilibrated non-polar solvent in it and the first acid layer is discarded.

After the first acid layer has been removed from the first funnel, then the remaining third non-polar solvent layer is drained into the second beaker, which contains the previously drained first and second non-polar solvent layers. This forms a pooled non-polar solvent layer including the first, second and third non-polar solvent layers, which all include the radioisotope from the previous extractions. At this point in the process, the radioisotope has been extracted from the stripped solution and is contained in the pooled non-polar solvent fraction.

F. Washing

After the radioisotope has been extracted from the stripped solution into a pooled non-polar solvent fraction including the radioisotope, the non-polar solvent fraction is washed. In some embodiments of the present disclosure, the non-polar solvent fraction is washed with an acid, in one embodiment HCl.

In some embodiments of the present disclosure, prior to being washed but after the non-polar solvent extraction, the pooled non-polar solvent fraction is returned to the first separator funnel. At this point, from about 3 ml to about 5 ml of non-polar solvent containing a dye may be added to the first funnel to create a colored-non-polar solvent layer including the radioisotope. In some embodiments, the dye is an azo dye, in one embodiment a red dye, or in another embodiment the azo dye is D & C Red 17. Thus, when a dye is added to the pooled non-polar solvent fraction, the pooled non-polar solvent fraction including the radioisotope is transformed to a colored-non-polar solvent layer including the radioisotope. The dye can be added so that during the washing process, one can differentiate easier between the non-polar solvent layer and the washing (e.g., acidic) layer.

After the non-polar solvent fraction is added to the first separator funnel (either with or without the dye), an acid can then be added to the first separator funnel. In one embodiment, the acid is HCl. Even more in one embodiment, the acid is 10 M HCl. In some embodiments, from about 20 ml to about 40 ml, in one embodiment about 30 ml of the acid is added to the first funnel. After the acid has been added to the first funnel, the acid and the non-polar solvent fraction are mixed. The acid and the non-polar solvent fraction can be mixed from about 3 minutes to about 7 minutes, in one embodiment for about 5 minutes.

After mixing, the acid and the non-polar solvent fraction are allowed to separate into a second acid layer and the non-polar solvent fraction including the radioisotope. In some embodiments, the separation takes from about 2 minutes to about 5 minutes. After separation, the second acid layer is drained out of the first funnel and discarded.

After the second acid layer has been drained and discarded, an acid (e.g., 10 M HCl) is again added to the first funnel, which still includes the non-polar solvent fraction. In some embodiments, from about 20 ml to about 40 ml, in one embodiment about 30 ml of the acid is added to the first funnel. After the acid has been added to the first funnel, the acid and the non-polar solvent fraction are mixed (e.g., from about 3 minutes to about 7 minutes) and are allowed to separate into a third acid layer and the non-polar solvent fraction including the radioisotope (e.g., from about 2 minutes to about 5 minutes of separation time). After separation, the third acid layer is drained out of the first funnel and discarded.

After the third acid layer has been drained and discarded, an acid (e.g., 10 M HCl) is again added to the first funnel, which still includes the non-polar solvent fraction. In some embodiments, from about 20 ml to about 40 ml, in one embodiment about 30 ml of the acid is added to the first funnel. After the acid has been added to the first funnel, the acid and the non-polar solvent fraction are mixed (e.g., from about 3 minutes to about 7 minutes) and are allowed to separate into a fourth acid layer and the non-polar solvent fraction including the radioisotope (e.g., from about 2 minutes to about 5 minutes of separation time). After separation, the fourth acid layer is drained out of the first funnel and discarded.

Once the fourth acid layer is drained from the first separator funnel, the non-polar solvent fraction remaining in the first funnel is mixed (e.g., from about 3 minutes to about 7 minutes). This mixing will pick up any excess acid (e.g., HCl) that is remaining in the funnel. After mixing the non-polar solvent and any excess acid are allowed to separate (e.g., from about 2 minutes to about 5 minutes of separation time) into a fifth acid layer and the non-polar solvent fraction including the radioisotope. After separation, the fifth acid layer is drained and discarded. At this point, the non-polar solvent fraction has been washed and is ready for the extraction using water.

G. Concentration of Germanium Radioisotope Using SPE Cartridge

In some embodiments, the extraction can be done with a diol cartridge. An example of a suitable diol cartridge that may be used in accordance with the present disclosure is a solid-phase extraction (SPE) cartridge. When a diol cartridge is used for the extraction, the following exemplary procedure may be carried out to obtain a radioisotope.

The following exemplary materials/reagents may be used for the diol cartridge extraction: (1) a vacuum pump (e.g., a Welch Model 2027 self-cleaning dry vacuum system); (2) a disposable 30 ml syringe; (3) a diol cartridge; (4) 18 gauge 1" needles; (5) a Teflon-faced stopper; (6) a 50 ml glass waste vial; (7) a 10 ml glass sample collection vial; (8) n-heptane; (9) 0.5M HCl; and, (10) heptane solution containing germanium.

In the exemplary procedure, the vacuum apparatus can be set up by fitting the 50 ml glass waste vial with a Teflon-faced stopper. Then, a hose from the vacuum pump can be connected to a needle, after which the needle can be inserted into the Teflon-faced stopper. At this point, a new needle can be obtained along with a cartridge and syringe. The plunger from the syringe can be removed and then discarded. The syringe barrel can then be attached to the cartridge. The new needle can also be attached to the cartridge. Then, the needle can be inserted into the Teflon-faced stopper on the glass waste vial.

Once the vacuum apparatus is configured, the cartridge can be prepared. The vacuum pump can be turned on and set to 25 mm mercury (Hg). Then, the cartridge can be pre-wet by transferring 5-10 ml of heptane into the syringe barrel, and the heptane can be drawn through the cartridge using the vacuum. This step saturates the cartridge with heptane and helps prevent oxygen to be drawn into the cartridge. Next, the heptane can be collected in the glass waste vial.

After the cartridge has been prepared, the radioisotope (e.g., germanium) can be loaded. First, the heptane solution containing, for example, germanium, can be transferred into the syringe barrel. Then, the solution can be drawn through the cartridge using the vacuum. Next, once the solution has completely passed through the cartridge, air can be continued to be drawn through the cartridge for at least one minute to dry the cartridge. Finally, the solution can be collected in a new waste vial and saved to be assayed at a later time, such as, for example, the following day.

When the radioisotope has been loaded, the next step can be elution of the radioisotope. First, a 10 ml glass vial can be attached to the Teflon-faced stopper, while leaving the rest of the vacuum apparatus intact. Then, the radioisotope can be eluted by transferring about 5 ml of 0.5M HCl into the syringe barrel and can be drawn through using the vacuum. The eluant can then be collected in the 10 ml glass vial. Once the eluant has completely passed through the cartridge, air can be continued to be drawn through the cartridge for at least one minute to dry the cartridge, at which point the vacuum can then be turned off. The vial can then be removed from the vacuum apparatus. The vial can be saved and assayed after, for example, gallium-68 has formed from germanium-68. This can be done the day after the elution. In some embodiments, the cartridge can be assayed again (e.g., the next day) to collect any residual radioisotope, such as gallium-68 from germanium-68.

In some embodiments of the present disclosure, if the aforementioned diol cartridge extraction is used, then one need not use the extraction using water described below in section "H."

H. Extraction Using Water

Once the non-polar solvent fraction including the radioisotope has been washed, the radioisotope is extracted from the non-polar solvent using water. Prior to the extraction using water, the non-polar solvent fraction including the radioisotope is transferred from the first separator funnel to a second separator funnel ("second funnel"). In some embodiments of the present disclosure, prior to the non-polar solvent fraction being transferred into the second funnel, the second funnel may be chilled to a temperature of about 10° C or less.

After the non-polar solvent fraction including the radioisotope is added to the second funnel, then water is added to the second funnel. In some embodiments, from about 5 ml to about 15 ml, and in one embodiment about 10 ml of water is added to the second funnel. Once the water has been added, the water and the non-polar solvent fraction are mixed in the second funnel. In some embodiments, the water and the non-polar solvent fraction are mixed from about 5 minutes to about 15 minutes, and in one embodiment about 10 minutes in the second funnel. After mixing, the water and the non-polar solvent fraction are allowed to separate into a pooled non-polar solvent fraction layer and a first water layer including the radioisotope. In some embodiments, the separation will occur from about 2 minutes to about 5 minutes. In some embodiments, the pooled non-polar solvent fraction is dyed. After separation, the first water layer including the radioisotope is drained into a fifth beaker.

After the first water layer including the radioisotope is drained into the fifth beaker, then water is again added to the second funnel, which still includes the pooled non-polar solvent fraction layer. In some embodiments, from about 5 ml to about 15 ml, and in one embodiment about 10 ml of water is added to the second funnel. Once the water has been added, the water and the pooled non-polar solvent fraction layer are mixed in the second funnel (e.g., from about 5 minutes to about 15 minutes) and are allowed to separate (e.g., from about 2 minutes to about 5 minutes) into the pooled non-polar solvent fraction layer and a second water layer including the radioisotope. After separation, the second water layer including the radioisotope is drained into the fifth beaker, which contains the first water layer including the radioisotope.

After the second water layer including the radioisotope is drained into the fifth beaker, then water is again added to the second funnel, which still includes the pooled non-polar solvent fraction layer. In some embodiments, from about 5 ml to about 15 ml, in one embodiment about 10 ml of water is added to the second funnel. Once the water has been added, the water and the pooled non-polar solvent fraction layer are mixed in the second funnel (e.g., from about 5 minutes to about 15 minutes) and are allowed to separate (e.g., from about 2 minutes to about 5 minutes) into the pooled non-polar solvent fraction layer and a third water layer including the radioisotope. After separation, the third water layer including the radioisotope is drained into the fifth beaker, which contains the first and second water layers including the radioisotope. The fifth beaker then contains a pooled water fraction including the radioisotope, which includes the first, second and third water layers including the radioisotope from the non-polar solvent extraction process. At this point, the radioisotope has been extracted from the non-polar solvent into the pooled water fraction and the non-polar solvent may be discarded.

I. Obtaining the Radioisotope

After the radioisotope has been extracted from the non-polar solvent fraction, the radioisotope may be obtained by itself from the water fraction. In some embodiments, the pooled water fraction including the radioisotope is heated to evaporate the water. In particular embodiments, the pooled water fraction is heated to evaporate the pooled water fraction to a volume of from about 3 ml to about 4 ml for a single target, and from about 4 ml to about 6 ml for dual targets. In some embodiments, the pooled water fraction is heated at a temperature of from about 65° C. to about 75° C. The heating process may take several hours, and in some embodiments last from about 1 hour to about 6 hours.

After the heating/evaporation occurs, then the radioisotope may be obtained. In some embodiments, the radioisotope is obtained in a more concentrated solution containing the radioisotope. In some embodiments, the solution is clear and colorless. In some particular embodiments, the radioisotope obtained is Ge-68. In some embodiments, the amount of radioisotope that can be obtained is from about 100 mCi to about 500 mCi.

In view of the present disclosure, it will be apparent that modifications and variations are possible in the process detailed herein without departing from the intended scope of the disclosure and as defined in the appended claims.

EXAMPLES

The following non-limiting examples are provided for illustrative purposes only, and therefore should not be viewed in a limiting sense.

Example 1

Dual 7-Day Bombardment of a Gallium-Nickel Alloy Target

A first gallium-nickel alloy target in accordance with the present disclosure was bombarded for about 7 days at an average beam current of about 186.35 micro-Amperes and a beam energy of about 29.4 MeV.

A second gallium-nickel alloy target in accordance with the present disclosure was also bombarded for about 7 days at an average beam current of about 186.35 micro-Amperes and a beam energy of about 29.1 MeV.

After about a two week decay time for each target, the targets were each processed in accordance with the radioisotope generation process disclosed throughout this disclosure. That is, each target underwent stripping with an acidic mixture including 4.5 M HCl and 10 M $HNO_3$, extraction using heptane, washing with 10 M HCl, and extraction using water.

The first water extraction used 9.5 ml of water. The second water extraction used 9.9 ml of water. The third water extraction used 9.9 ml of water.

Both processed target solutions were pooled together and measured for Ge-68 content. A total Ge-68 activity of about 479 milliCuries was obtained, which contained about 40 milliCuries of Ge-69A summary of the activity in each fraction is given in Table 1:

TABLE 1

Activity Fractions from Dual Seven-Day Targets

| Fraction | mCi Ge-68 | % Ge-68 | mCi Ge-69 | % Ge-69 |
|---|---|---|---|---|
| Water-1 | 418 | 87.3 | 34.9 | 87.3 |
| Water-2 | 37.6 | 7.85 | 3.24 | 8.10 |
| Water-3 | 23.2 | 4.48 | 1.85 | 4.63 |

As can be seen from the percentages extracted, the Ge-69 chemically behaves like the Ge-68.

Example 2

4.4-Day Bombardment of a Gallium-Nickel Alloy Target

A gallium-nickel alloy target in accordance with the present disclosure was bombarded for about 4.4 days at an average beam current of about 183.5 micro-Amperes and a beam energy of about 29.5 MeV.

After about an 18-day decay time, the target was processed in accordance with the radioisotope generation process disclosed throughout this disclosure. That is, the target underwent stripping with an acidic mixture including 4.5 M HCl and 10 M $HNO_3$, extraction using heptane, washing with 10 M HCl, and extraction using water.

The first water extraction used 9.5 ml of water. The second water extraction used 9.2 ml of water. The third water extraction used 9.5 ml of water.

A total Ge-68 activity of 104.321 milliCuries was obtained, which contained some Ge-69. A summary of the activity in each fraction is given in Table 2:

TABLE 2

Activity Fraction from 4.4-Day Target

| Fraction | mCi Ge-68 | % Ge-68 |
|---|---|---|
| Water-1 | 90.012 | 86.2 |
| Water-2 | 12.799 | 12.2 |
| Water-3 | 1.783 | 1.7 |

When introducing elements of the present invention or the preferred embodiment(s) thereof, the articles “a”, “an”, “the” and “said” are intended to mean that there are one or more of the elements. The terms “comprising”, “including” and “having” are intended to be inclusive and mean that there may be additional elements other than the listed elements.

As various changes could be made in the above methods and compositions (including concentrations ranges, etc.) without departing from the scope of the present disclosure, it is intended that all matter contained in the above description shall be interpreted as illustrative and not limiting in any sense.

What is claimed is:

1. A process for generating a radioisotope, the process comprising:

bombarding a target body including a starting material, wherein the starting material is an alloy comprising gallium and nickel, and wherein the bombardment of the starting material produces a radioisotope within the target body; then allowing the bombarded target body to decay; then stripping the intact bombarded target body with an acidic mixture to create a stripped solution, wherein the acidic mixture includes copper (II) nitrate trihydrate and nitric acid; then extracting the radioisotope from the stripped solution using a non-polar solvent to remove the acidic mixture and create a non-polar solvent fraction including the radioisotope; then washing the non-polar solvent fraction including the radioisotope; and then extracting the radioisotope from the non-polar solvent fraction using water.

2. The process of claim 1, wherein the radioisotope is germanium-68.

3. The process of claim 1, wherein the alloy includes from about 10% to about 80% gallium, by weight of the alloy.

4. The process of claim 1, wherein the alloy includes from about 60% to about 75% gallium and from about 25% to about 40% nickel, by weight of the alloy.

5. The process of claim 1, wherein the target body is bombarded by a particle accelerator.

6. The process of claim 5, wherein the particle accelerator includes a cyclotron.

7. The process of claim 1, wherein the non-polar solvent fraction is washed with HCI.

8. The process of claim 1, wherein the non-polar solvent is selected from the group consisting of heptane, hexane, cyclohexane, pentane and carbon tetrachloride.

9. A method of using a target body to produce germanium-68, the method comprising:

bombarding a target body including a gallium-nickel alloy, wherein the bombardment of the gallium-nickel alloy produces a germanium radioisotope within the target body; then allowing the bombarded target body to decay; then stripping the intact bombarded target body with an acidic mixture to create a stripped solution, wherein the acidic mixture includes copper (II) nitrate trihydrate and nitric acid; then extracting the germanium radioisotope from the stripped solution using a non-polar solvent to remove the acidic mixture and create a non-polar solvent fraction including the germanium radioisotope; then washing the non-polar solvent fraction including the germanium radioisotope; and then extracting the germanium radioisotope from the non-polar solvent fraction using water.

10. The method of claim 9, wherein the non-polar solvent is selected from the group consisting of heptane, hexane, cyclohexane, pentane and carbon tetrachloride.

11. The method of claim 9, wherein the alloy includes from about 60% to about 75% gallium and from about 25% to about 40% nickel, by weight of the alloy.

12. The method of claim 9, wherein the non-polar solvent fraction is washed with HCI.

* * * * *